US007614119B2

(12) United States Patent
Hsu

(10) Patent No.: US 7,614,119 B2
(45) Date of Patent: Nov. 10, 2009

(54) HINGE TO IMPROVE PANEL STABILITY

(75) Inventor: Jia-Hao Hsu, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 541 days.

(21) Appl. No.: 11/476,714

(22) Filed: Jun. 29, 2006

(65) Prior Publication Data

US 2008/0000050 A1 Jan. 3, 2008

(51) Int. Cl.
*E05D 3/10* (2006.01)

(52) U.S. Cl. ..... 16/367

(58) Field of Classification Search ..... 16/337–339, 16/342, 330, 303, 374, 376, 377, 340, 386; 361/680–683, 814; 455/90.3, 575.1, 575.3, 455/575.8; 379/433.12, 433.13; 348/373, 348/333.01, 333.06, 794
See application file for complete search history.

(56) References Cited

U.S. PATENT DOCUMENTS 6,742,221 B2 * 6/2004 Lu et al. ..... 16/367
6,850,407 B2 * 2/2005 Tanimoto et al. ..... 361/681
7,036,187 B2 * 5/2006 Rude ..... 16/342
7,189,023 B2 * 3/2007 Kang et al. ..... 403/119
2005/0207104 A1 * 9/2005 Love ..... 361/683
2005/0251965 A1 * 11/2005 Lu et al. ..... 16/367
2006/0282985 A1 * 12/2006 Lu et al. ..... 16/367

* cited by examiner

*Primary Examiner*—Chuck Y. Mah
(74) *Attorney, Agent, or Firm*—Rosenberg, Klein & Lee

(57) ABSTRACT

A hinge mounted in an electrical appliance having a panel and a base has a rotating bracket, two shaft assemblies, a stationary bracket, a spacer assembly and a flat contact surface. The shaft assemblies are mounted rotatably in the rotating bracket and are attached to the panel. The stationary bracket is mounted rotatably around the rotating bracket and is attached to the base. The spacer assembly is mounted around the rotating bracket and securely on the stationary bracket. The flat contact surface is formed between the rotating bracket and the spacer assembly to provide a flat contact when the rotating bracket rotates relative to the spacer assembly. Therefore, the panel will not shake when the panel is rotated right or left relative to the base.

9 Claims, 7 Drawing Sheets

HINGE TO IMPROVE PANEL STABILITY

BACKGROUND OF THE INVENTION

1. Field of the Invention

The present invention relates to a hinge, especially to a hinge connecting a panel to a base to improve panel stability and keep the panel from shaking.

2. Description of the Prior Arts

Electrical appliances such as notebook computers, cell phones, etc. have a panel, a base and a conventional hinge. The conventional hinge connects the panel to the base along a transverse axis and a longitudinal axis to allow the panel to pivot relative to the base. When the conventional hinge pivots along the transverse axis, the panel is opened or closed relative to the base. When the conventional hinge pivots along the longitudinal axis, the panel is turned left or right relative to the base. The conventional hinge comprises a stationary leaf, a rotating leaf and a contact surface. The stationary leaf connects to the base. The rotating leaf connects to the panel to allow the panel to turn left or right relative to the base. However, the contact surface between the stationary leaf and the rotating leaf is not flat. When the panel is turned left or right relative to the base, the non-flat contact surface between the panel and base easily causes the panel to shake.

To overcome the shortcomings, the present invention provides a hinge to improve panel stability to mitigate or obviate the aforementioned problems.

SUMMARY OF THE INVENTION

The main objective of the present invention is to provide a hinge to improve panel stability and keep an attached panel from shaking. The hinge mounted in an electrical appliance has a rotating bracket, two shaft assemblies, a stationary bracket, a spacer assembly and a flat contact surface. The electrical appliance has a panel and a base. The shaft assemblies are mounted rotatably in the rotating bracket and are attached to the panel. The stationary bracket is mounted rotatably around the rotating bracket and is attached to the base. The spacer assembly is mounted around the rotating bracket and is mounted securely on the stationary bracket. The flat contact surface is formed between the rotating bracket and the spacer assembly to provide a flat contact to allow the rotating bracket to rotate relative to the spacer assembly. Therefore, the panel will not shake when the panel is rotated right or left relative to the base.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
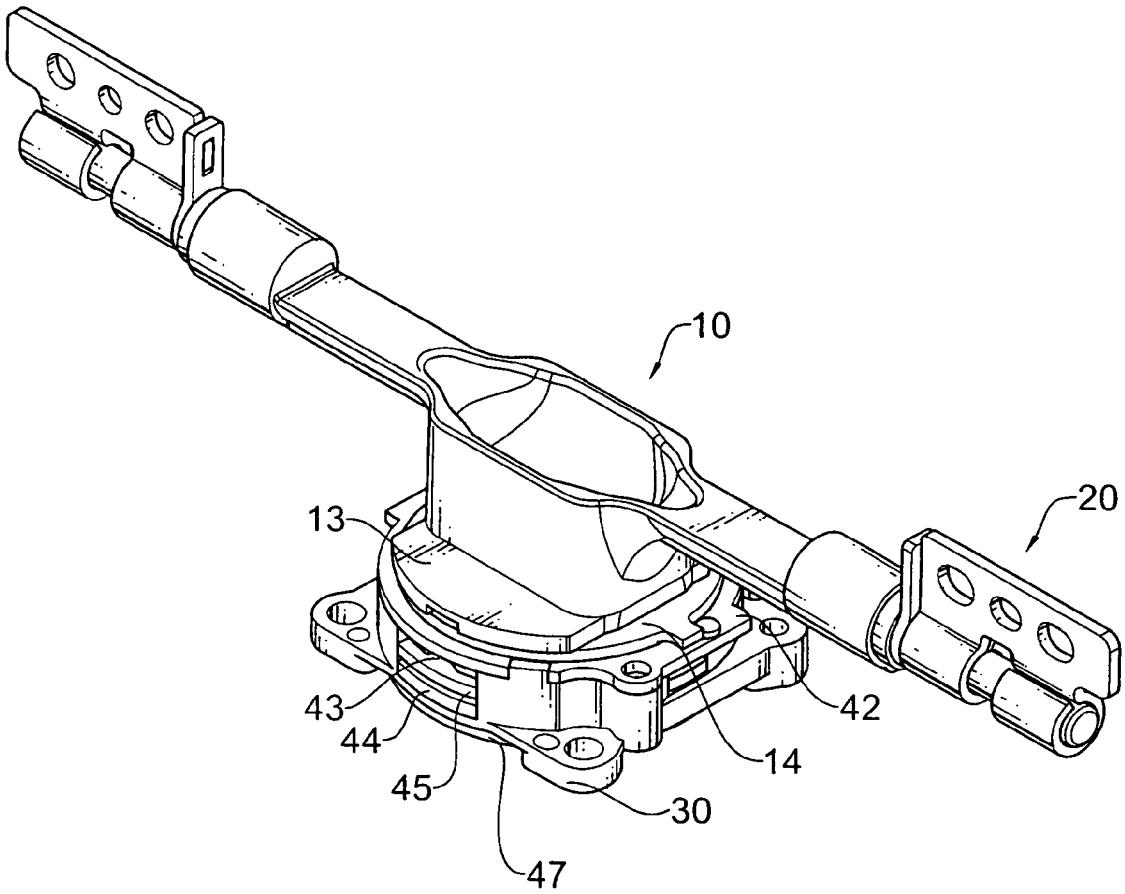
FIG. 1 is a perspective view of a hinge to improve panel stability in accordance with the present invention.
Figure 2:
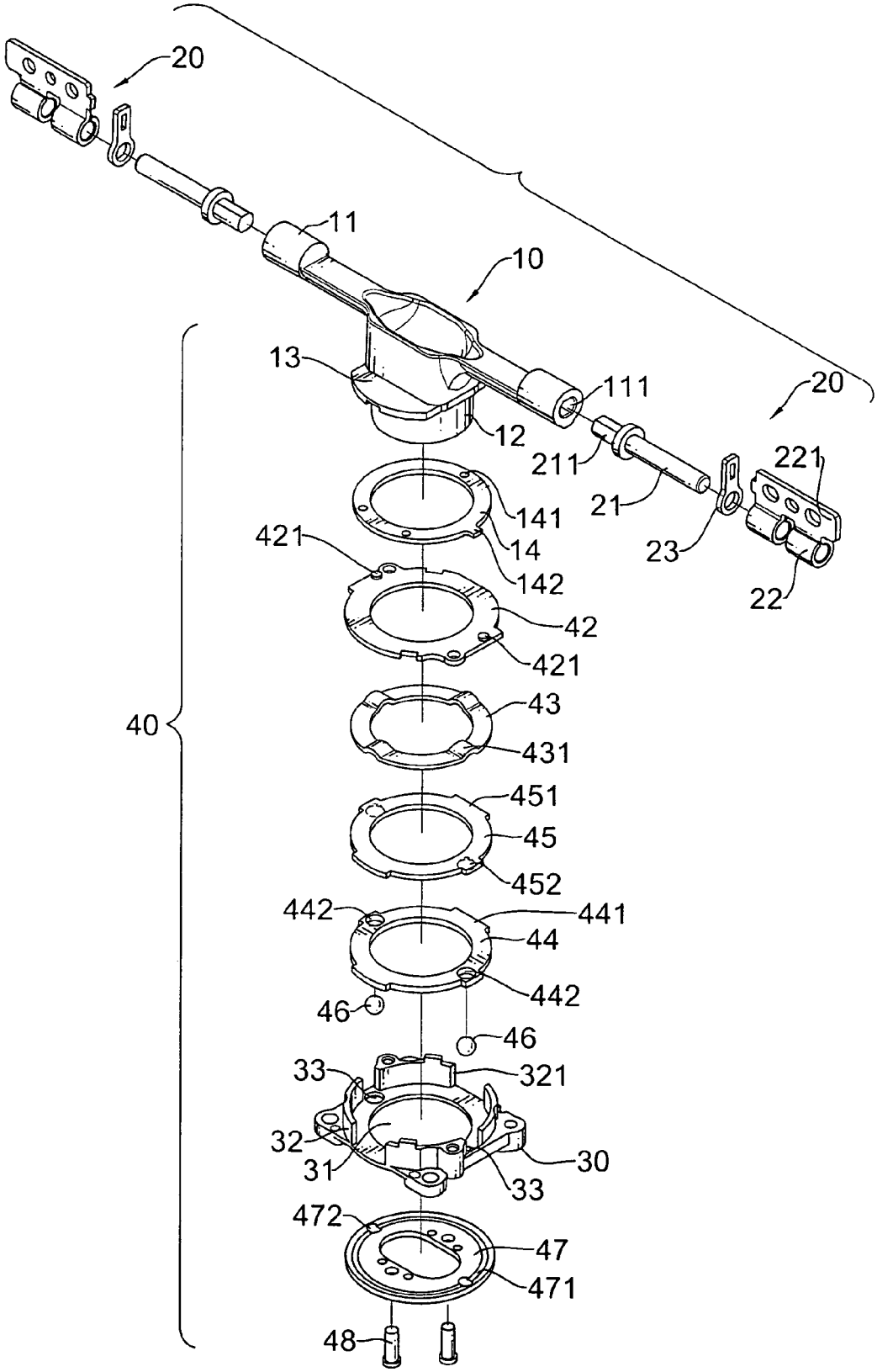
FIG. 2 is an exploded perspective view of the hinge in FIG. 1.
Figure 3:
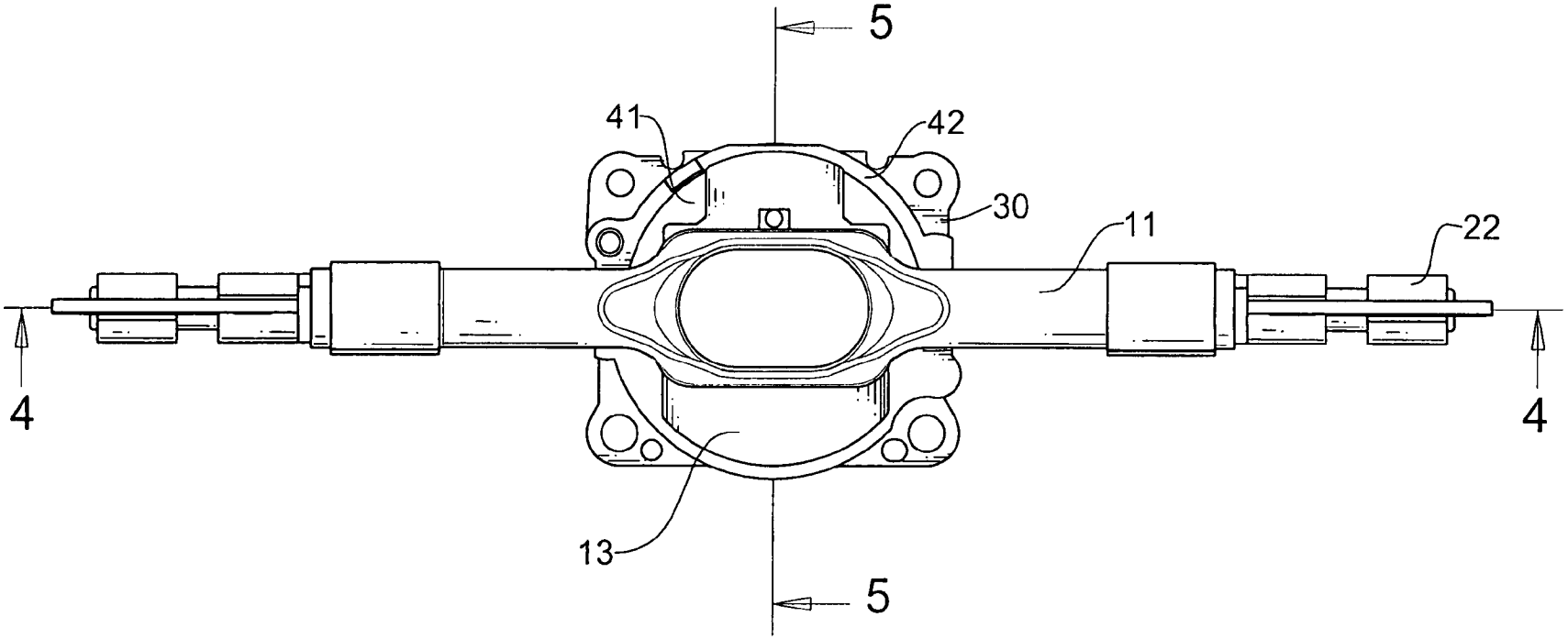
FIG. 3 is a top view of the hinge in FIG. 1.

With reference to FIGS. 1, 2 and 3, a hinge to improve panel stability in accordance with the present invention comprises a rotating bracket (10), two shaft assemblies (20), a stationary bracket (30), a spacer assembly (40) and a flat contact surface.

Figure 5:
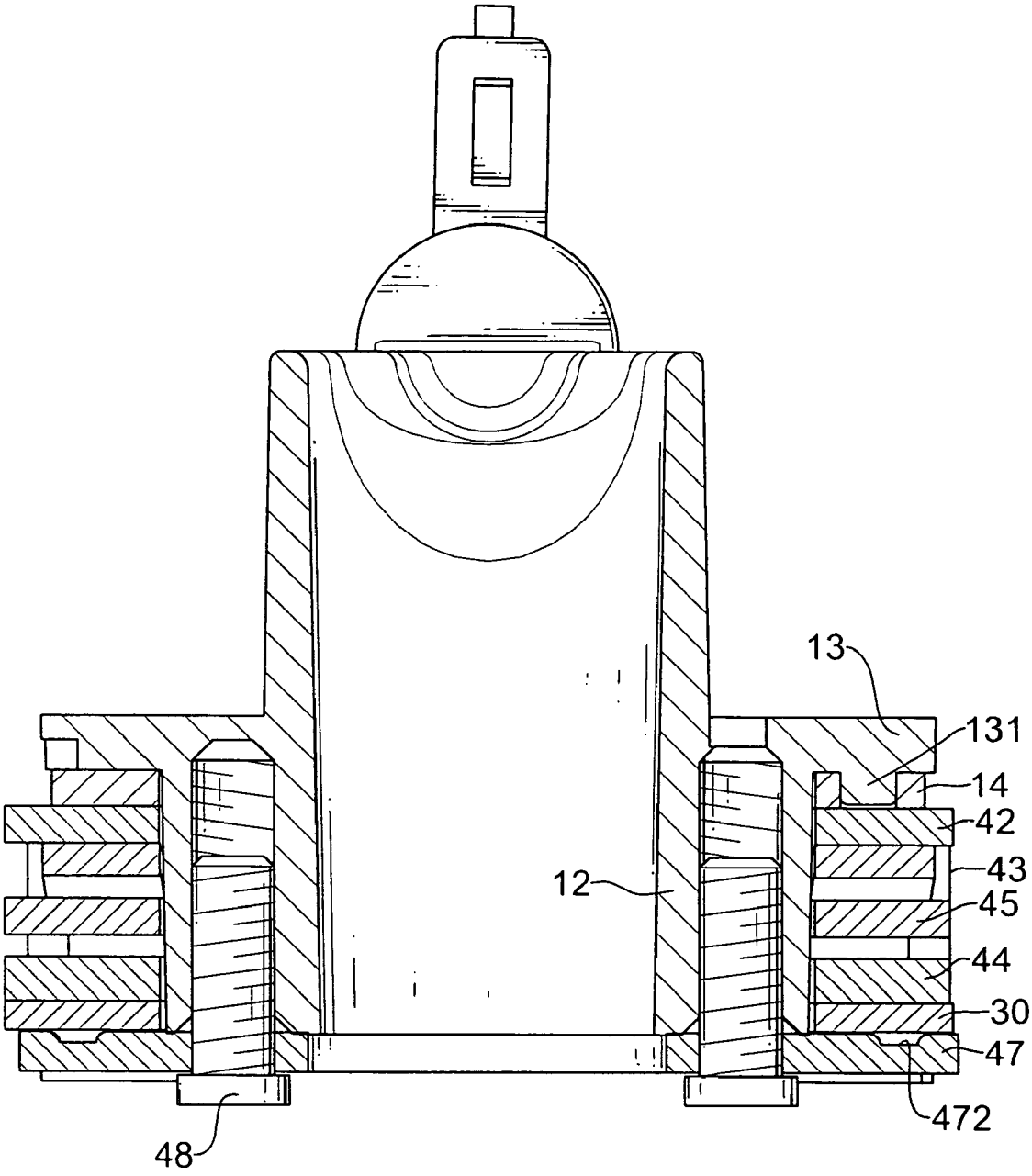
FIG. 5 is an enlarged side view in partial section of the hinge along line 5-5 in FIG. 3.

With further reference to FIG. 5, the rotating bracket (10) has two sides, a top, a bottom, two transverse arms, a longitudinal shaft (12), a flange (13) and an optional rotation limit (14). The transverse arms are formed respectively on and protrude radially out from the sides of the rotating bracket (10) at the top, and each transverse arm has a distal end and a connecting sleeve (11). The connecting sleeves (11) are formed respectively on and protrude longitudinally from the distal ends of the transverse arms, and each connecting sleeve (11) may have a non-circular central hole (111). The longitudinal shaft (12) is formed coaxially on and protrudes longitudinally from the bottom of the rotating bracket (10) and has a top and a bottom. The flange (13) is formed coaxially on and protrudes radially out from the bottom of the rotating bracket (10) and the top of the longitudinal shaft (12), has a bottom surface and may have one or more fastening protrusions (131). The one or more fastening protrusions (131) extend down from the bottom surface of the flange (13). The rotation limit (14) is mounted around the longitudinal shaft (12), is attached to the flange (13) and may be implemented with an outer edge, one or more mounting holes (141) and a limit (142). The one or more mounting holes (141) are formed through the rotation limit (14) and correspond respectively to and engage the one or more fastening protrusions (131) on the flange (13) to attach the rotation limit (14) to the flange (13). The limit (142) is formed on and extends radially out from the edge of the rotation limit (14).

Figure 6:
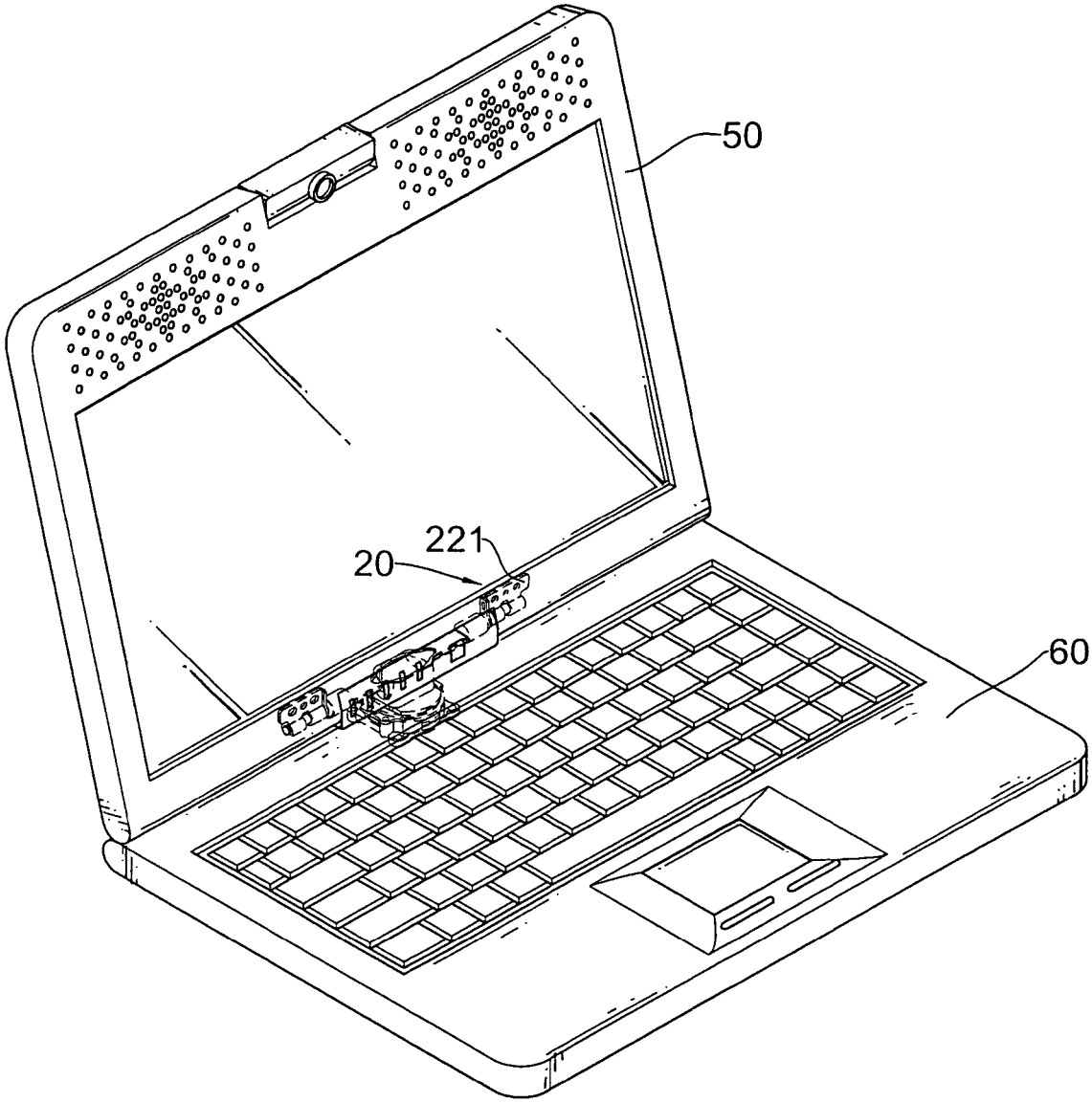
FIG. 6 is an operational perspective view of a notebook computer with the hinge in FIG. 1.

The shaft assemblies (20) connect respectively to the connecting sleeves (11) of the rotating bracket (10), each shaft assembly (20) comprises a shaft (21), a barrel (22) and an optional leaf support (23). The shaft (21) is mounted securely in the connecting sleeve (11) and may have a non-circular locking rod (211) engaging the central hole (111) in the connecting sleeve (11). The barrel (22) is mounted rotatably on the shaft (21) and may have a leaf (221). With further reference to FIG. 6, the leaves (221) are longitudinally attached respectively to and protrude out from the barrels (22) and connect to a notebook computer panel (50). When the panel (50) is rotated to open or close relative to the base (60), the panel (50) rotates the barrels (22) relative to the shafts (21). The leaf support (23) is mounted rotatably on the shaft (21) and is attached to the barrel (22) and the leaf (221). The leaf supports (23) attached to the barrels (22) steady the barrels (22) to keep the panel (50) from shaking when the panel (50) is opened or closed relative to the base (60).

The stationary bracket (30) is mounted around the longitudinal shaft (12) of the rotating bracket (10) to connect a notebook computer panel (50) rotatably and pivotally to a notebook computer base (60) and has a top surface, a bottom surface, a central hole (31), an optional annular sidewall (32) and two optional through holes (33). The central hole (31) is mounted rotatably around the longitudinal shaft (12) of the rotating bracket (10). The annular sidewall (32) is formed on and protrudes perpendicularly up from the top surface of the stationary bracket (30) and has multiple gaps (321). The gaps (321) are formed through the annular sidewall (32) and communicate with the top surface of the stationary bracket (30). The through holes (33) are formed through the stationary bracket (30) diametrically opposite to each other outside the central hole (31) in two of the gaps (321).

The spacer assembly (40) is mounted rotatably around the longitudinal shaft (12) of the rotating bracket (10) and securely on the stationary bracket (30), has a retaining cap (47) and two optional connecting pins (48) and may include a limiting spacer (42), a resilient spacer (43), a alignment spacer (44), a mounting spacer (45) and two balls (46).

Figure 4:
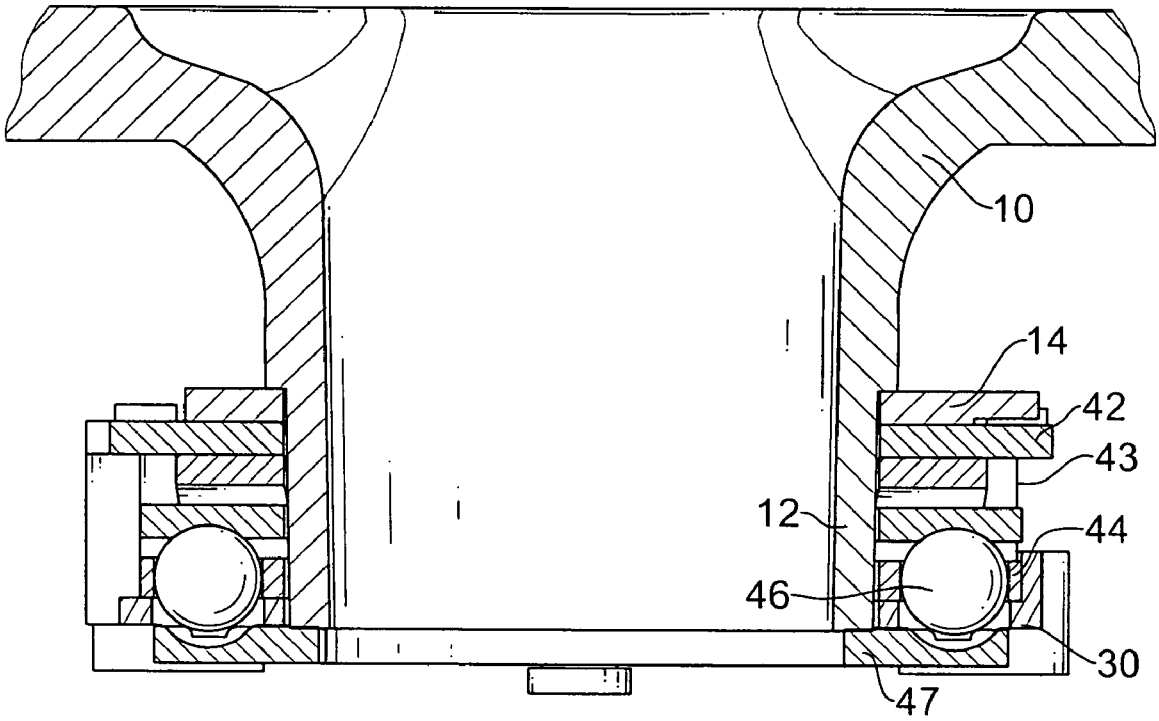
FIG. 4 is an enlarged front view in partial section of the hinge along line 4-4 in FIG. 3.

With further reference to FIG. 4, the retaining cap (47) is attached to the longitudinal shaft (12), is mounted rotatably against the bottom surface of the stationary bracket (30) and has a top surface, an optional annular channel (471) and two optional detents (472). The top surface rotatably abuts the bottom surface of the stationary bracket (30). The annular channel (471) is formed in the top surface of the retaining cap (47) and corresponds respectively to the through holes (33) in the stationary bracket (30). The detents (472) are formed diametrically opposite to each other in the annular channel (471) and correspond respectively to and align with the through holes (33) in the stationary bracket (30). Each detent (472) has two inclined ends. The inclined ends correspond to the annular channel (471).

The connecting pins (48) connect the retaining cap (47) to the bottom of the longitudinal shaft (12) of the rotating bracket (10) and have a shaft and a head. The shaft extends through and is held in the retaining cap (47) and has a proximal end and a distal end. The distal end connects to the bottom of the longitudinal shaft (12). The head is formed on the proximal end and abuts the bottom surface of the retaining cap (47).

The limiting spacer (42) is mounted rotatably around the longitudinal shaft (12) securely on the stationary bracket (30) and has a top surface and two stops (421). The stops (421) are formed on and protrude up from the top surface of the limiting spacer (42) and selectively abut the limit (142) of the rotation limit (14) to limit rotation of the rotation limit (14) to a specific angle.

The resilient spacer (43) is mounted around the longitudinal shaft (12) and has multiple curved protrusions (421) abutting the limiting spacer (42).

The alignment spacer (44) is mounted around the longitudinal shaft (12) inside the annular sidewall (32) on the stationary bracket (30) and has an edge, two keys (441) and two through holes (442). The keys (441) are formed on and extend out from the edge of the alignment spacer (44) and engage the gaps (321) in the annular sidewall (32) of the stationary bracket (30) to hold the alignment spacer (44) in place in the annular sidewall (32). The through holes (442) are formed through the alignment spacer (44) diametrically opposite to each other and correspond respectively to and align with the through holes (33) in the stationary bracket (30).

The mounting spacer (45) is mounted around the longitudinal shaft (12) between the resilient spacer (43) and the alignment spacer (44) and has an edge, a bottom surface, two keys (451) and two mounting recesses (452). The keys (451) are formed on and extend out from the edge of the mounting spacer (45) and engage the gaps (321) in the annular sidewall (32) of the stationary bracket (30) to hold the mounting spacer (45) in position in the annular sidewall (32). The mounting recesses (452) are formed in the bottom surface of the alignment spacer (44) and correspond respectively to and align with the through holes (442) in the alignment spacer (44).

The balls (46) are mounted respectively in the through holes (442) in the alignment spacer (44) and respectively in the through holes (33) in the stationary bracket (30), engage the corresponding mounting recesses (452) in the mounting spacer (45), slide in the annular channel (471) in the retaining cap (47) and selectively engage the detents (472) in the retaining cap (47) to hold the rotating bracket (10) in place.

The flat contact surface is formed between the rotating bracket (10) and the spacer assembly (40) to provide a flat contact when the rotating bracket (10) rotates relative to the spacer assembly (40). The flat contact surface may be formed between the rotation limit (14) and the limiting spacer (42).

Figure 7:
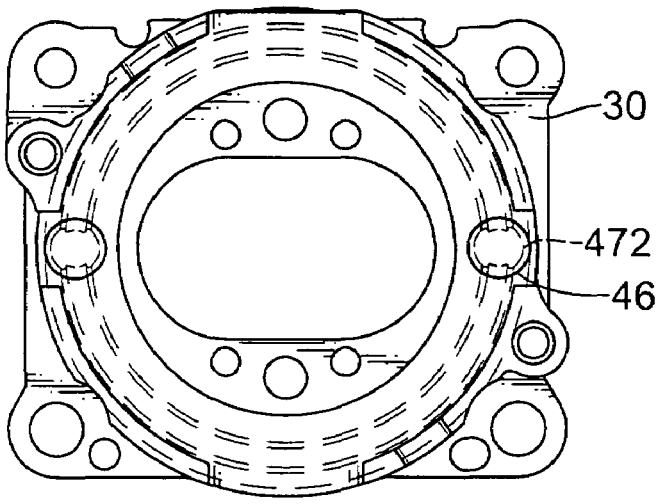
FIG. 7 is an enlarged operational partial bottom view of the hinge in FIG. 1.
Figure 8:
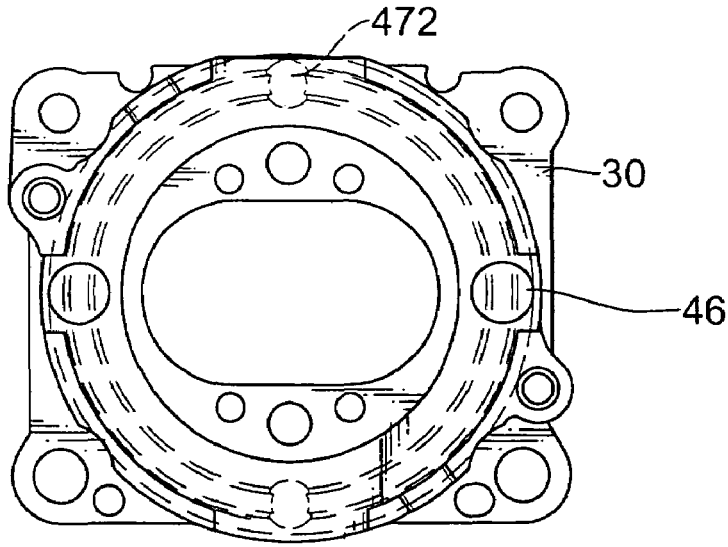
FIG. 8 is an enlarged operational partial bottom view of the hinge in FIG. 1.

With further reference to FIGS. 7 and 8, the panel (50) is rotated right or left relative to the base (60) to rotate the rotating bracket (10) relative to the spacer assembly (40). Because the retaining cap (47) is attached to the longitudinal shaft (12) and the balls (46) are mounted securely in the through holes (442, 33) in the alignment spacer (44) and in the stationary bracket (30), the balls (46) slide in the annular channel (471) in the retaining cap (47). When the balls (46) engage the detents (472) in the retaining cap (47), the hinge of the present invention provides the panel (50) to position relative to the base (60). The limit (142) of the rotation limit (14) selectively abuts the stops (421) of the limiting spacer (42) to limit a rotating angle of the panel (50). Because the contact surface between the rotation limit (14) and the limiting spacer (42) is flat, the rotating bracket (10) will not tilt when the rotating bracket (10) is rotated relative to the spacer assembly (40). Therefore, the panel (50) will not shake when the panel (50) is rotated to turn right or left relative to the base (60).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hinge comprising:

a rotating bracket having
- two sides;
- a top;
- a bottom;
- two transverse arms being formed respectively on and protruding radially out from the sides of the rotating bracket at the top, and each transverse arm having
  - a distal end; and
  - a connecting sleeve formed on and protruding longitudinally from the distal end of the transverse arm;
- a longitudinal shaft formed coaxially on and protruding longitudinally from the bottom of the rotating bracket and having
  - a top; and
  - a bottom;
- a flange being formed coaxially on and protruding radially out from the bottom of the rotating bracket and the top of the longitudinal shaft and having a bottom surface; and
- a rotation limit mounted around the longitudinal shaft and attached to the flange;

two shaft assemblies connecting respectively to the connecting sleeves of the rotating bracket, and each shaft assembly comprising
- a shaft being mounted securely in a corresponding connecting sleeve; and
- a barrel being mounted rotatably on the shaft;

a stationary bracket being mounted around the longitudinal shaft of the rotating bracket and having a top surface;

a bottom surface; and a central hole being mounted rotatably around the longitudinal shaft of the rotating bracket;

a spacer assembly being mounted rotatably around the longitudinal shaft of the rotating bracket and securely on the stationary bracket and having a retaining cap attached to the longitudinal shaft, mounted rotatably against the bottom surface of the stationary bracket and having a top surface rotatably abutting the bottom surface of the stationary bracket; and a limiting spacer mounted rotatably around the longitudinal shaft and securely on the stationary bracket and having a top surface; and two stops formed on and protruding up from the top surface; and a flat contact surface being formed between the rotation limit of the rotating bracket and the limiting spacer of the spacer assembly to provide a flat contact when the rotating bracket rotates relative to the spacer assembly.

2. The hinge as claimed in claim 1, wherein the spacer assembly further has two connecting pins connecting the retaining cap to the bottom of the longitudinal shaft of the rotating bracket and each having a shaft extending through and held in the retaining cap and having a proximal end; and a distal end connected to the bottom of the longitudinal shaft; and a head being formed on the proximal end and abutting the bottom surface of the retaining cap.

3. The hinge as claimed in claim 1, wherein the rotation limit has an outer edge; and a limit formed on and extending radially out from the edge of the rotation limit; and the stops on the limiting spacer selectively abut the limit of the rotation limit.

4. The hinge as claimed 3, wherein the flange further has at least one fastening protrusion extending down from the bottom surface of the flange; and the rotation limit further has at least one hole formed through the rotation limit and corresponding respectively to and engaging the at least one fastening protrusion on the flange.

5. The hinge as claimed in claim 1, wherein the stationary bracket further has an annular sidewall being formed on and protruding perpendicularly up from the top surface of the stationary bracket and having multiple gaps formed through the annular sidewall and communicating with the top surface of the stationary bracket; and two through holes formed through the stationary bracket diametrically opposite to each other outside the central hole in two of the gaps;

the retaining cap of the spacer assembly further has an annular channel formed in the top surface of the retaining cap and corresponding to the through holes in the stationary bracket; and two detents formed diametrically opposite to each other in the annular channel and corresponding respectively to and aligning with the through holes in the stationary bracket; and the spacer assembly further has a resilient spacer mounted around the longitudinal shaft and having multiple curved protrusions abutting the limiting spacer;

an alignment spacer mounted around the longitudinal shaft inside the annular sidewall on the stationary bracket and having an edge;

two keys formed on and extending out from the edge of the alignment spacer and engaging two of the gaps in the annular sidewall of the stationary bracket; and two through holes formed through the alignment spacer diametrically opposite to each other and corresponding respectively to and aligning with the through holes in the stationary bracket;

a mounting spacer mounted around the longitudinal shaft between the resilient spacer and the alignment spacer and having an edge;

a bottom surface;

two keys formed on and extending out from the edge of the mounting spacer and engaging two of the gaps in the annular sidewall of the stationary bracket; and two mounting recesses formed in the bottom surface of the alignment spacer and corresponding respectively to and aligning with the through holes in the alignment spacer; and two balls mounted respectively in the through holes in the alignment spacer and respectively in the through holes in the stationary bracket, engaging the corresponding mounting recesses in the mounting spacer, sliding in the annular channel in the retaining cap and selectively engaging the detents in the retaining cap.

6. The hinge as claimed in claim 5, wherein each detent in the retaining cap has two inclined ends corresponding to the annular channel.

7. The hinge as claimed in claim 5, wherein the spacer assembly further has two connecting pins connecting the retaining cap to the bottom of the longitudinal shaft of the rotating bracket and each having a shaft extending through and held in the retaining cap and having a proximal end; and a distal end connected to the bottom of the longitudinal shaft; and a head being formed on the proximal end and abutting the bottom surface of the retaining cap.

8. The hinge as claimed in claim 6, wherein the spacer assembly further has two connecting pins connecting the retaining cap to the bottom of the longitudinal shaft of the rotating bracket and each having a shaft extending through and held in the retaining cap and having a proximal end; and a distal end connected to the bottom of the longitudinal shaft; and a head being formed on the proximal end and abutting the bottom surface of the retaining cap.

9. The hinge as claimed in claim 1, wherein each shaft assembly has a leaf support being attached to the barrel.

* * * * *

UNITED STATES PATENT AND TRADEMARK OFFICE

CERTIFICATE OF CORRECTION

PATENT NO. : 7,614,119 B2
APPLICATION NO. : 11/476714
DATED : November 10, 2009
INVENTOR(S) : Jia-Hao Hsu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 675 days.

Signed and Sealed this

Nineteenth Day of October, 2010

David J. Kappos

David J. Kappos
*Director of the United States Patent and Trademark Office*